US009016023B2

(12) United States Patent
Timko et al.

(10) Patent No.: US 9,016,023 B2
(45) Date of Patent: Apr. 28, 2015

(54) MULTI-PURPOSE COLUMN ASSEMBLY

(71) Applicant: Fry Reglet Corporation, Alhambra, CA (US)

(72) Inventors: William J. Timko, Suwanee, GA (US); Richard Stonis, Atlanta, GA (US)

(73) Assignee: Fry Reglet Corporation, Alhambra, CA (US)

( * ) Notice: Subject to any disclaimer, the term of this patent is extended or adjusted under 35 U.S.C. 154(b) by 0 days.

(21) Appl. No.: 14/137,643

(22) Filed: Dec. 20, 2013

(65) Prior Publication Data

US 2014/0174019 A1 Jun. 26, 2014

Related U.S. Application Data

(60) Provisional application No. 61/740,521, filed on Dec. 21, 2012.

(51) Int. Cl.

| | |
|---|---|
| ***E04H 12/00*** | (2006.01) |
| ***E04C 3/30*** | (2006.01) |
| ***F21V 21/10*** | (2006.01) |
| *E04B 2/74* | (2006.01) |
| *E04C 3/04* | (2006.01) |
| *F21V 21/116* | (2006.01) |

(52) U.S. Cl.

CPC ..... *E04C 3/30* (2013.01); *E04B 2002/747* (2013.01); *E04C 2003/0421* (2013.01); *E04C 2003/0439* (2013.01); *E04C 2003/0465* (2013.01); *F21V 21/10* (2013.01); *F21V 21/116* (2013.01)

(58) Field of Classification Search

CPC ..... E04C 3/30; E04B 2002/7464; E04B 2002/747

USPC ..... 52/73, 78, 220.2, 36.1, 27, 36.4, 28, 40, 52/651.07, 844, 511, 36.2; 312/209, 247, 312/223.5; 248/125.1, 132; 135/89; 108/50.02, 67

See application file for complete search history.

(56) References Cited

U.S. PATENT DOCUMENTS

| | | | | | |
|---|---|---|---|---|---|
| 2,982,593 | A * | 5/1961 | Chambers | 312/101 |
| 3,338,002 | A * | 8/1967 | Ericsson et al. | 52/28 |
| 3,769,502 | A * | 10/1973 | Schultz et al. | 362/85 |
| 4,015,397 | A * | 4/1977 | Flachbarth et al. | 52/713 |
| 5,182,883 | A * | 2/1993 | Amberson et al. | 52/73 |
| 5,452,807 | A * | 9/1995 | Foster et al. | 211/26 |
| 5,455,975 | A * | 10/1995 | Foster | 5/600 |
| 5,511,348 | A * | 4/1996 | Cornell et al. | 52/239 |
| 5,685,113 | A * | 11/1997 | Reuter et al. | 52/220.7 |
| 5,802,778 | A * | 9/1998 | Thorp et al. | 52/36.2 |
| 5,974,742 | A * | 11/1999 | Schreiner et al. | 52/36.1 |
| 6,248,014 | B1 * | 6/2001 | Collier | 454/228 |
| 6,256,935 | B1 * | 7/2001 | Walker | 52/27 |
| 6,267,064 | B1 * | 7/2001 | Ostertag et al. | 108/50.02 |
| 6,571,519 | B1 * | 6/2003 | Diffrient et al. | 52/239 |
| 6,631,591 | B1 * | 10/2003 | Durham | 52/73 |
| 6,817,149 | B2 * | 11/2004 | Diffrient et al. | 52/239 |
| 7,219,472 | B2 * | 5/2007 | Gallant et al. | 52/36.2 |
| 7,827,920 | B2 * | 11/2010 | Beck et al. | 108/50.02 |
| 7,865,983 | B2 * | 1/2011 | Newkirk et al. | 5/503.1 |
| 7,971,396 | B1 * | 7/2011 | Culpepper | 52/27 |
| 7,971,404 | B2 * | 7/2011 | Timko et al. | 52/511 |
| 8,707,648 | B2 * | 4/2014 | Timko et al. | 52/511 |

* cited by examiner

*Primary Examiner* — Chi Q Nguyen

(74) *Attorney, Agent, or Firm* — Kilpatrick Townsend & Stockton LLP

(57) ABSTRACT

Column assemblies for work environments that support the acoustical, lighting, and cabling needs for the environment.

17 Claims, 5 Drawing Sheets

MULTI-PURPOSE COLUMN ASSEMBLY

CROSS-REFERENCE TO RELATED APPLICATION

The present application claims the benefit of U.S. Provisional Patent Application Ser. No. 61/740,521, filed Dec. 21, 2012, the disclosure of which is incorporated herein by this reference in its entirety.

FIELD OF THE INVENTION

The present invention relates to columns for open-plan work environments, and more particularly to columns for open-plan work environments that provide acoustic, lighting, and cabling needs for the environment.

BACKGROUND

Today's work environments are trending away from traditional drywall enclosures and acoustical ceilings and towards open spaces, also known as "open-plan work environments," which are better suited for collaborative work processes. With this trend, it has become difficult to provide basic support elements to the appropriate locations within the space. For example, traditional drywall constructions provide a cavity that accepts power and data wiring and acoustical ceilings provide for the suspension of lighting and for acoustical control. Such walls and ceilings are absent in open-plan work environments. As a result, open-plan work environments lack basic infrastructure to moderate sound in the environment, provide for wide area lighting, and arrange cabling in the space, including but not limited to electrical, data, and telephone cabling. Thus, while open-plan work environments can help foster collaborative work environments, these shortcomings can make the environment less functionally appealing than other, more traditional workspaces.

SUMMARY

The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings and each claim.

Column assemblies for work environments that support the acoustical, lighting, and cabling needs for the environment are described herein.

BRIEF DESCRIPTION OF THE DRAWINGS

Illustrative embodiments of the present invention are described in detail below with reference to the following drawing figures.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Embodiments of the invention provide free-standing columns that support the needs (e.g., data and power cables and wires routing, lighting, acoustics, etc.) of an environment, such as an office environment. The column may be particularly suitable for use in, but certainly not limited to use in, open-plan work environments. As these environments trend away from traditional drywall enclosures and acoustical ceilings towards open spaces better suited for collaborative work processes, it has become difficult to provide basic support elements to the appropriate locations within the space. Traditional walls provide a cavity that accepts power and data wiring; acoustical ceilings provide for the suspension of lighting and for acoustical control. Embodiments of the columns disclosed herein provide a solution for all of these needs when such walls and ceilings are absent.

Figure 1:
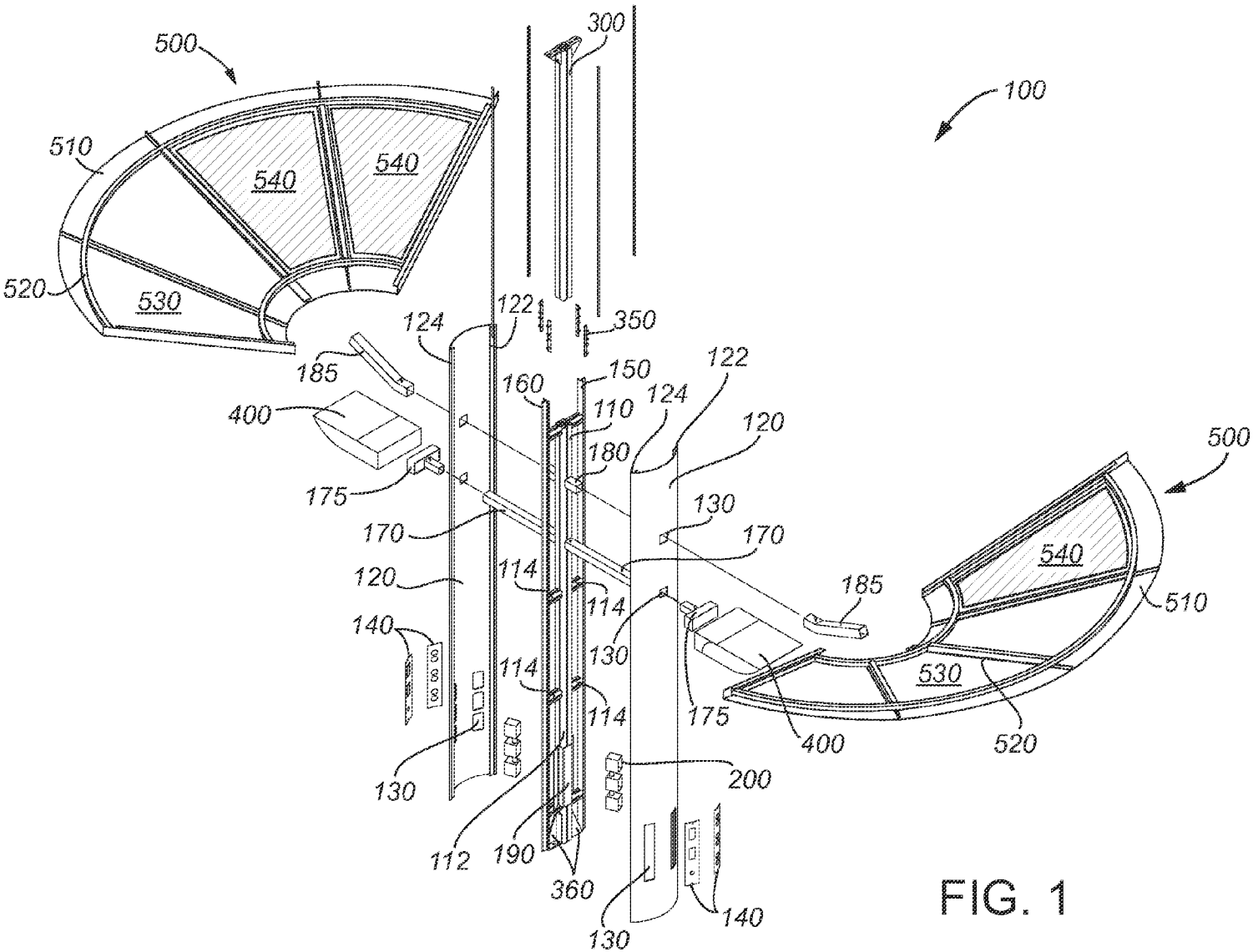
FIG. 1 is an exploded top perspective view of a column assembly according to an embodiment of the invention.

With reference to FIG. 1, embodiments of the column assembly 100 may include a frame 110 enclosed by a panel skin 120 that can have apertures 130 and/or removable panels 140 for access into the interior of the column assembly 100.

While different configurations of the frame are contemplated, including its integral formation, in one embodiment the frame is formed by a main center post 112, first and second side support posts 150, 160, and horizontal posts 114. One or more of the horizontal posts 114 may attach to the center post 112 and to the side support posts 150, 160 to secure the framework together.

The frame may further include a plurality of support elements 170, 180 attached thereto. The support elements 170, 180 retain mounting elements 175, 185 on the frame 110 for attaching components such as lighting fixtures and a canopy to the column assembly 100, as described in more detail below.

The frame 110 may also include a mounting bracket 190 onto which a plurality of outlet boxes 200 are mounted. The outlet boxes receive one or more of electrical, data, telephone or other cabling (not shown) for use in equipment in the work environment. The cabling typically drops down from the ceiling (although in some work environments it could come up through the floor), where it would run along the frame 110 and terminate at the respective outlet box 200.

A panel skin 120 extends around the frame 110 to enclose the frame 110 and form a cavity between the frame 110 and panel skin 120 to accommodate cables and wiring. The panel skin 120 may be of any cross-sectional shape, including but not limited to circular, elliptical, oval, square, rectangular, etc. In some embodiments, the panel skin 120 is formed of at least two panel skin sections 120, each of which extends at least partially around the frame 110 so as to enclose the frame 110.

Figure 2:
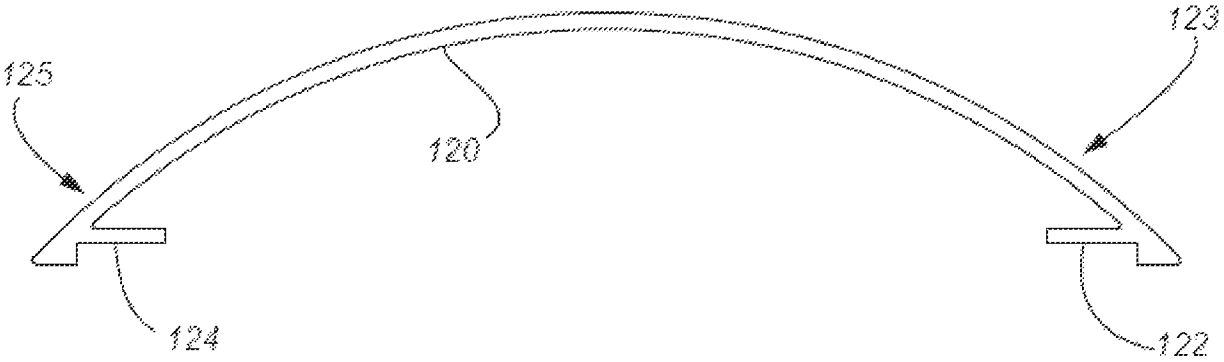
FIG. 2 is a top view of a panel skin section according to an embodiment of the invention.
Figure 3:
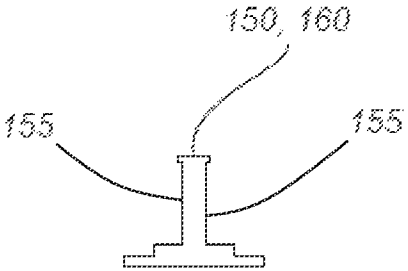
FIG. 3 is a top view of a support post according to an embodiment of the invention.
Figure 6:
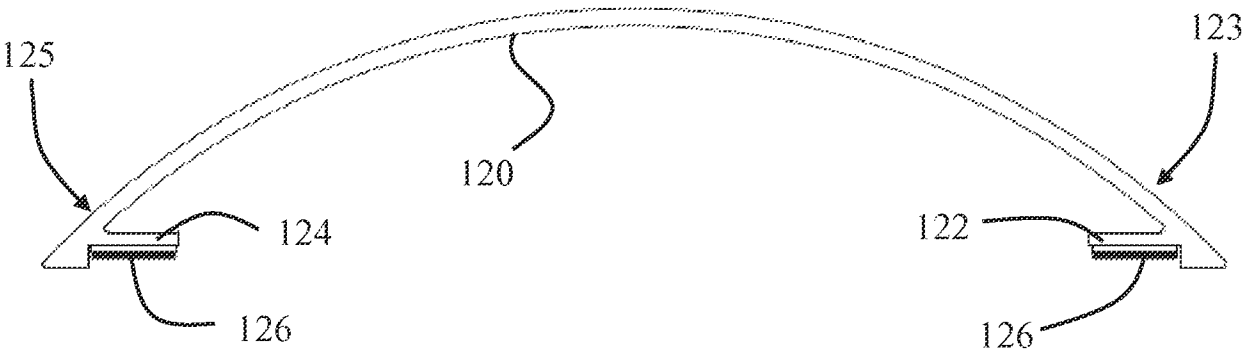
FIG. 6 is a top view of a panel skin section according to an embodiment of the invention showing a hook-and-loop type fastening system.
Figure 7:
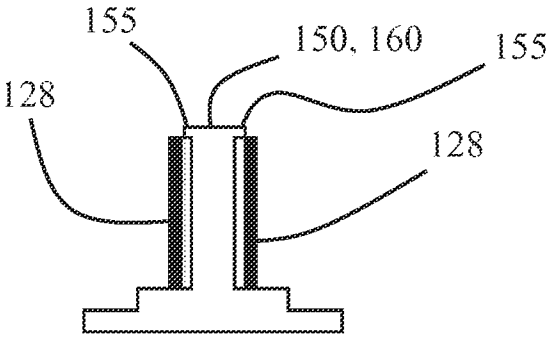
FIG. 7 is a top view of a support post according to an embodiment of the invention showing a hook-and-loop type fastening system.

The panel skin sections 120 may be connected directly to each other or to the frame 110 using any mechanical retention method. In some embodiments, each panel skin section 120 is mounted on the support posts 150, 160 of the frame 110. FIG. 2 shows a top view of an exemplary panel skin section 120, and FIG. 3 shows a top view of an exemplary side support post (150, 160) onto which the panel skin section 120 may attach. Obviously, the panel skin sections 120 and support posts 150, 160 can be of any shapes that complement each other to facilitate their coupling. In the illustrated embodiment, the panel skin section 120 includes a first ledge 122 on a first side 123 and a second ledge 124 on a second side 125. The ledges 122, 124 extend inwardly into the panel skin section 120. The support posts 150, 160 include portions 155 onto which the ledges 122, 124 of the panel skin section 120 can rest. The panel skin sections 120 may removably attach to the side support posts 150, 160 with any suitable fastening system, such as double-sided adhesive tape or a snap-fit connector. In some embodiments, however, the panel skin sections 120 removably attach to the side support posts 150, 160 using a hook-and-loop fastening system (e.g., industrial-strength Velcro®) (see, e.g., 126, 128 in FIGS. 6 and 7). Removing the panel skin sections 120 by, e.g., separating the hook-and-loop fastener allows access to cables and other components enclosed by the panel skin sections 120 within the interior of the column assembly.

Apertures 130 are provided in the panel skin 120, so that when the column assembly 100 is assembled, the apertures 130 of the panel skin 120 align with various features supported by and extending from the frame 110, such as outlet boxes 200 and support elements 170, 180. Moreover, apertures 130 permit cabling to be pulled through the column assembly and terminated/used in the appropriate electrical/electronic component in the workspace. It will also be apparent that, when the panel skin 120 is in place on the frame 110, the cabling will be hidden from view from the exterior of the column assembly 100, providing an aesthetically pleasing system for providing electrical and electronic connections to the work environment.

Figure 4C:
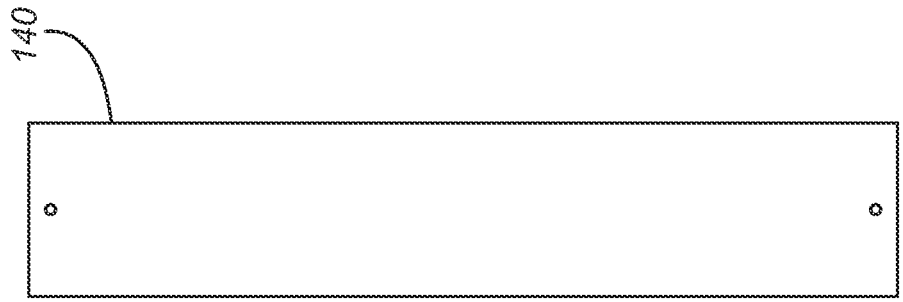
FIG. 4C is a front view of a removable panel according to a further embodiment of the invention.
Figure 4B:
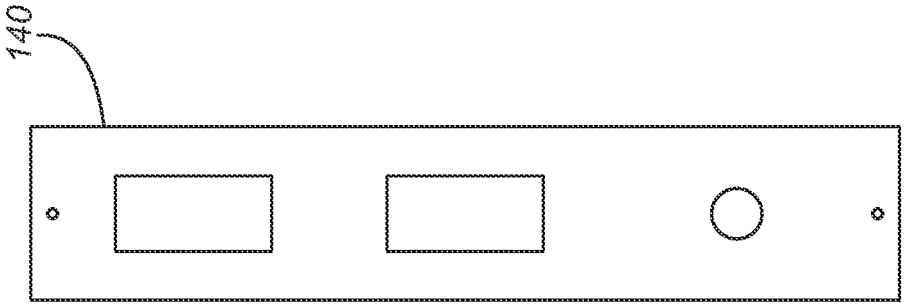
FIG. 4B is a front view of a removable panel according to another embodiment of the invention.
Figure 4A:
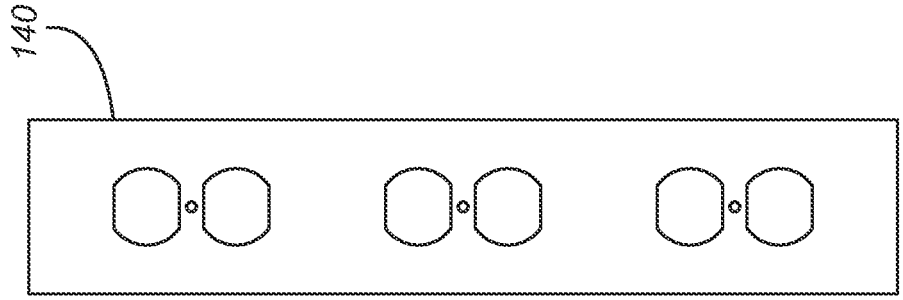
FIG. 4A is a front view of a removable panel according to one embodiment of the invention.

With reference to FIGS. 4A-4C, aesthetic and decorative aspects of the column assembly 100 may be further enhanced by providing one or more removable cover plates or panels 140 configured to fit over or within apertures 130 in the panel skin 120. The panels 140 are tailored for the particular electrical application underlying the panels 140, such as for electrical outlets (see FIG. 4A) or for data boxes (see FIG. 4B). The removable panel 140 in FIG. 4C is solid, and could be provided in instances where outlet boxes and/or cabling are located behind the removable panel 140 but not in current use (i.e., the cabling is staged for future use).

Figure 5B:
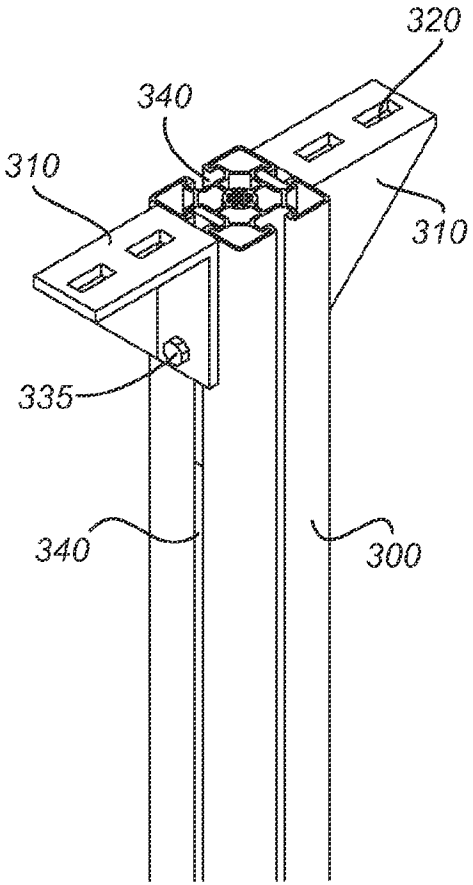
FIG. 5B is a top perspective view of a joined frame upper section and upper support gusset according to an embodiment of the invention.
Figure 5A:
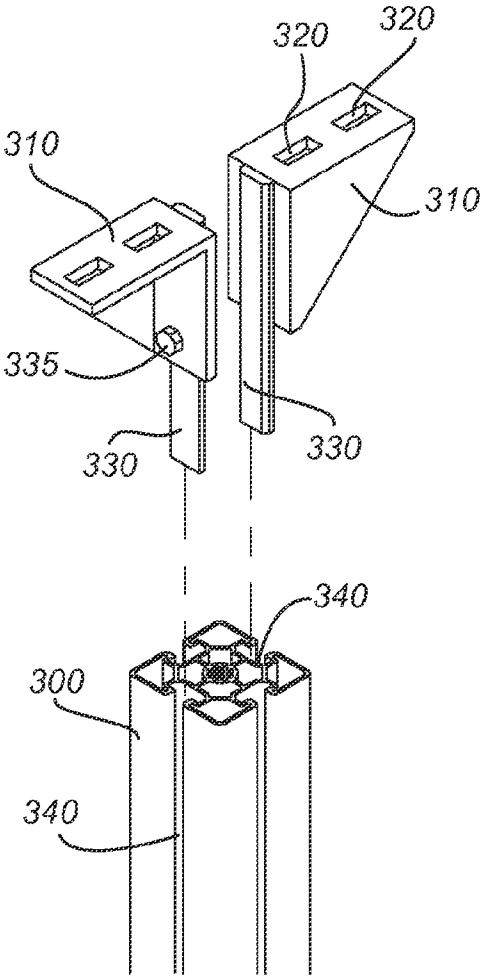
FIG. 5A is a top perspective view of a frame upper section and upper support gusset according to an embodiment of the invention.

In some embodiments, the frame 110 may include at least two frame sections. As shown in FIG. 1, the frame 110 includes an upper section 300 and a lower section (also labeled as 110) which may be connected to one another by at least one splice plate 350. Specifically, the upper section 300 and lower section 110 each include at least one channel 340 (see FIGS. 5A and 5B for exemplary channels 340 shown in upper section 300; lower section 110 includes similar channels). The at least one splice plate 350 may be inserted into a channel 340 in each frame section and secured in each frame section with at least one fastener (e.g., a screw or bolt), thus connecting the frame sections to one another. As shown in FIG. 1, four splice plates 350 engage four channels 340 in each of the upper and lower frame sections to secure the frame sections to one another (physical connection not shown). Having multiple frame sections provides for a reduced profile for shipping, and allows for ease of manufacturing for different installation lengths. For example, a standard size/length can be constructed for the lower section 110, and different upper section 300 lengths can be constructed to accommodate different ceiling heights. Alternatively, a standard upper section 300 length can be used and this section can easily be cut on-site as necessary.

The frame 110 may be attached to the floor/deck of the work environment with at least one floor gusset 360. In other embodiments, however, the frame 110 may be directly fastened to the floor with a fastener (not shown).

In any event, the frame 110 extends vertically from the floor to the ceiling/upper deck (slab) above. Some embodiments of the column assembly are designed to accommodate movement of the ceiling for normal expansion and contraction, or for seismic events where required. To that end, the upper section 300 of the column assembly 100 may be secured to the ceiling by at least one upper support gusset 310 that is slidable relative to the upper section 300. This feature is shown in more detail in FIGS. 5A and 5B. Specifically, upper support gusset 310 can include at least one gusset aperture 320 for receiving a fastener (not shown) for securing the upper support gusset 310 to the ceiling. A pin 330 extends downwardly from the upper support gusset 310 and is connected thereto by a fastener 335. The pin 330 engages the channel 340 in the upper section 300, but is not fastened therein. The pin "floats" in the channel 340, and can slide up and down within the channel 340. Thus, with the upper section 300 rigidly connected to the lower section 110—which is rigidly connected to the floor of the work environment—and the upper support gusset 310 rigidly connected to the ceiling of the work environment and the pin 330 of the upper support gusset 310 slidingly engaged in the channel 340 of the upper section 300, it will be apparent that when the ceiling/upper deck of the work environment flexes up and down, the upper support gusset 310 will also move up and down relative to the upper section 300 but the column assembly 100 will remain in place. While the figures show an embodiment including two frame sections (upper section 300 and lower section 110), it will be apparent that if only one frame section is used at least one sliding upper support gusset can be used to attach the upper portion of the single frame section to the ceiling in a similar manner.

Further, it will be apparent that, when installing the column assembly 100, and in particular when sizing the upper section 300, it will be desirable to leave a gap between the top of the upper section 300 and the ceiling/upper deck of the work environment to accommodate this movement; if no gap is provided then any compression of the space would compress the column assembly 100 and could result in damage thereto. In some embodiments, it will be desirable to leave a gap of from about 1" to about 3" between the top of the upper section 300 and the ceiling. In further embodiments it may be desirable to leave a gap of about 1.5" between the top of the upper section 300 and the ceiling. Of course, it will be recognized that the length of the pin 330 within the channel 340 should be sufficient to accommodate any anticipated expansion of the space; if the space flexes to the extent that the pin 330 disengages from the channel 340, the column assembly 100 would no longer be retained at its upper end and could fall over, obviously an undesirable result.

In addition to providing desired electrical connections, the column assembly may be provided with other accessories to enhance its utility within a space. For example, one or more lighting fixtures may be supported on the column assembly. FIG. 1 illustrates two lighting fixtures 400, each supported on the column by a mounting element 175.

The lighting fixtures 400 may be oriented to emit light upwardly, outwardly, and/or downwardly from the column assembly 100. The wiring for the lighting fixtures may be retained within the mounting elements 175 and support elements 170 and thus remain hidden from view external to the column assembly 100.

In yet another embodiment, a canopy 500 is supported on the column assembly 100, such as with at least one mounting element 185. As shown in FIG. 1, the canopy 500 is provided in two canopy sections 510, each canopy section 510 supported by a respective mounting element 185 attached to a respective support element 180. Mounting elements 185 are illustrated as angled brackets provided on the distal end of each support element 180, although one of skill in the art will understand that the geometry of the mounting elements 185 are not limited to those illustrated in FIG. 1 but rather the mounting elements 185 may have any suitable geometry. Further, it will be appreciated that while two canopy sections 510 are shown, the canopy 500 could be formed from any number of canopy sections, including a single section. Of course, if the canopy 500 were a single section, the column assembly 100 may need to be assembled differently, for example, by positioning the canopy 500 over the lower section of the frame 110 prior to attaching the upper section 300 thereto.

Further, the canopy 500 may extend around the entire perimeter of the column assembly or alternatively, gaps may be located between adjacent canopy sections 510.

In the disclosed embodiment, the canopy sections 510 each include a canopy framework 520 with canopy panels 530 attached to the underside of the framework 520. However, the canopy panel(s) 530 could also be formed integrally with the canopy sections 510. The canopy and canopy panel(s) may have any shape or geometry. For example, while shown in FIG. 1 as having a conical shape with the narrower portion positioned nearer the floor and the wider portion positioned nearer the ceiling, in another embodiment the canopy may have an inverted conical shape with the narrower portion positioned nearer the ceiling and the wider portion positioned nearer the floor. This configuration would provide different light distribution and sound absorption characteristics which may be desirable in some work environments or by some customers. Of course, other canopy shapes and geometries are possible and within the scope of the present invention, such as pyramid-shaped configurations (facing either direction) or substantially two-dimensional circular, elliptical, square or rectangular-shaped geometries.

In the disclosed embodiment, the lighting fixtures 400 are oriented to direct light substantially upwardly so that the emitted light impinges on, and can be reflected by, the lower surface of the canopy panels 530 (i.e., the part of the canopy 500 seen from below) toward work surfaces positioned around the column assembly 100. The lower surface of the canopy panels 530 can be treated so as to customize the canopy 500 for a desired application. For example, the lower surface of the canopy panels 530 can be provided with a reflective treatment to control the directionality of, and thereby attain the desired distribution of, light reflected off the lower surface of the canopy panels 530. In some embodiments, the reflective treatment is paint, such as reflective paint. The reflective treatment may also be a reflective metallic layer or reflective polymeric material applied to the surface of the canopy panels 530. In yet other embodiments, the canopy panels 530 may be integrally formed from a reflective material, such as a metallic material (e.g., aluminum) or a polymeric material having reflective properties.

Moreover, in some embodiments, the canopy panels 530 are designed and fabricated in a manner that provides for a level of acoustical control to the area surrounding the column. For example, the canopy panels 530 may include a sound absorbing material 540 (e.g., fleece scrim) positioned and retained on the upper surface of the panels. In this way, the canopy 500 absorbs noise within the work environment and thereby helps control the noise level in an open work environment. Further, the canopy panels 530 may be perforated so as to allow sound to pass through the canopy panels and be absorbed by the sound absorbing material 540. While perforated canopy panels 530 may provide better sound absorption performance because sound can both pass through the perforations in the canopy panels 530 to be absorbed by the sound absorbing material 540 and also bounce off the ceiling/upper deck and then be absorbed by the sound absorbing material 540, it will be appreciated that non-perforated canopy panels 530 having a sound absorbing material 540 positioned on the upper surface thereof would also provide some measure of sound absorption due to absorption of reflected sounds off the ceiling/upper deck of the work environment.

While FIG. 1 shows support elements 170, 180 and mounting elements 175, 185 as separate components, it will be understood that components such as lighting fixtures 400 and a canopy 500 may be directly attached to the frame 110 using only a single element; in other words a lighting fixture could directly attach to the frame using a support element 170 or a canopy could directly attach to the frame with a support element 180.

The various components of the column assembly (e.g., frame, panel skin, side support posts, support elements, mounting elements, gussets, canopy, etc.) may be formed of any materials having suitable structural integrity, including, but not limited to, metallic materials (e.g., aluminum, steel, iron, etc.) or polymeric materials (e.g., polycarbonate, polyvinyl chloride, etc.). Moreover, it may be desired to tailor the appearance of the exposed portions of the column assembly 100 to correspond with the surrounding environment and decor. For example and by way only of example, the exterior of the column assembly 100 (e.g., panel skin 120 and lower surface of the canopy 500) may be painted, covered with a decorative fabric, or otherwise provided with a surface treatment.

Methods of manufacturing and installing a column assembly 100 such as those described above provide for mass-production of major components of the column assembly 100 by a vendor with customization of individual components to satisfy demands of individual customers. For example, as described generally above the frame/lower section 110 including main center post 112, horizontal posts 114 and optional support elements 170, 180 may be mass-produced, as these components should be suitable for most customer installations. Additionally, solid panel skin sections 120, canopy sections 510, outlet boxes 200, upper section 300 and various other components could be mass-produced and shipped to the seller/installer.

The seller/installer may receive an order from a customer for an installation for a particular work space, and then customize the design of each column assembly 100 for the customer by arranging the outlet boxes 200 on the frame 110, selecting the correct length for the upper section 300 (or cutting the upper section 300 to the appropriate length on-site), and cutting appropriately sized and located apertures 130 in the panel skin sections 120 for the required outlet boxes and support elements 170, 180. The seller/installer can also prepare the panel skin sections 120 and canopy 500 with appropriate decorative and/or reflective features as described above (as desired and if not already integrally formed into, e.g., the canopy). Lighting fixtures can be provided and installed by the installer or alternatively can be selected and installed by the customer on the provided mounting elements 175.

The installer can then assemble the column assembly on-site and either run the cabling to the appropriate outlet boxes (if available) and complete the assembly or the installer (or even the customer) could wait to install the panel skin sections 120 until after the electrician/data technician completes the wiring.

Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

That which is claimed is:

1. A column assembly comprising:

a frame;

a plurality of support elements attached to the frame, the plurality of support elements comprising at least one light fixture support element and at least one canopy support element;

a canopy mounted on the at least one canopy support element, the canopy comprising a lower surface facing a floor and an upper surface facing a ceiling, wherein the canopy comprises an acoustic element and a light reflective element; and a panel skin at least partially surrounding the frame so as to form a cavity between the panel skin and the frame to accommodate cables so that the cables are not visible from outside the column assembly; and wherein the acoustic element comprises a sound absorbing material located on the upper surface of the canopy.

2. The column assembly of claim 1, wherein the frame comprises a first support post and a second post and the panel skin comprises at least two panel skin sections, wherein each panel skin section comprises a first side that attaches to the first support post and a second side that attaches to the second support post.

3. The column assembly of claim 2, wherein the first and second sides of each panel skin section attaches to the first and second support posts of the frame with a hook and loop fastener.

4. The column assembly of claim 2, wherein the first and second sides of each panel skin section attaches to the first and second support posts of the frame with a removable adhesive.

5. The column assembly of claim 1, wherein the frame supports at least one outlet box for providing at least one of electrical, data and telephone cabling to the work environment.

6. The column assembly of claim 5, wherein the panel skin comprises at least one aperture that aligns with the at least one outlet box supported on the frame.

7. The column assembly of claim 1, wherein the sound absorbing material is a fleece scrim.

8. The column assembly of claim 1, wherein the canopy is at least partially perforated so as to allow sound to pass through the canopy and be absorbed by the sound absorbing material located on the upper surface thereof.

9. The column assembly of claim 1, wherein the light reflective element comprises a reflective treatment applied to a lower surface of the canopy facing a floor.

10. The column assembly of claim 9, wherein the reflective treatment is paint, a metallic material, or a polymeric material.

11. The column assembly of claim 1, wherein the canopy is formed from a reflective material, and the light reflective element comprises the reflective material.

12. The column assembly of claim 1, wherein the frame comprises at least two sections comprising a lower section and an upper section, and wherein the upper section and lower section are connected to one another with at least one splice plate.

13. The column assembly of claim 12, further comprising at least one upper support gusset adapted for rigid attachment to a ceiling, wherein the at least one upper support gusset engages but is not rigidly attached to the upper section so as to be slidable relative to the upper section.

14. The column assembly of claim 1, further comprising a light fixture mounted on the at least one light fixture support element.

15. A column assembly for use in an open-plan work environment, comprising:

a frame comprising a first support post and a second support post, a plurality of support elements attached to the frame, the plurality of support elements comprising at least one light fixture support element and at least one canopy support element;

a canopy mounted on the at least one canopy support element, comprising a lower surface facing a floor and an upper surface facing a ceiling, the canopy comprising an acoustic element comprising a sound absorbing material located on the upper surface and a light reflective element located on the lower surface, wherein the canopy is at least partially perforated so as to allow sound to pass through the canopy and be absorbed by the sound absorbing material;

a plurality of outlet boxes located on the frame for providing at least one of electrical, data and telephone cabling to the work environment; and a panel skin comprising at least two panel skin sections, each panel skin section comprising a first side that attaches to the first support post and a second side that attaches to the second support post, wherein the first and second sides of each panel skin section attach to the first and second support posts with a hook and loop fastener, wherein the panel skin at least partially surrounds the frame so as to form a cavity between the panel skin and the frame to accommodate cables so that the cables are not visible from outside the column assembly.

16. The column assembly of claim 15, wherein the frame comprises at least two sections comprising a lower section and an upper section, and wherein the upper section and lower section are connected to one another with at least one splice plate.

17. The column assembly of claim 16, further comprising at least one upper support gusset adapted for rigid attachment to a ceiling, wherein the at least one upper support gusset engages but is not rigidly attached to the upper section so as to be slidable relative to the upper section.

* * * * *